US005123775A

United States Patent [19]

Bryant

[11] Patent Number: 5,123,775

[45] Date of Patent: Jun. 23, 1992

[54] ALUMINUM CAN TRUCK-MOUNTED ATTENUATOR

[75] Inventor: Bobbie E. Bryant, Blue Springs, Mo.

[73] Assignee: Graham-Migletz Enterprises, Inc., Independence, Mo.

[21] Appl. No.: 636,745

[22] Filed: Dec. 31, 1990

[51] Int. Cl.[5] ..... E01F 13/00

[52] U.S. Cl. ..... 404/6

[58] Field of Search ..... 404/6; 296/189, 901

[56] References Cited

U.S. PATENT DOCUMENTS

| | | | |
|---|---|---|---|
| 3,680,662 | 8/1972 | Walker et al. | 404/6 X |
| 3,845,936 | 11/1974 | Boedecker et al. | 404/6 X |
| 3,853,349 | 12/1974 | Moore | 296/189 |
| 3,856,268 | 12/1974 | Fitch | 404/6 X |
| 3,876,185 | 4/1975 | Welch | 404/6 X |
| 3,951,384 | 4/1976 | Hildreth, Jr. | 404/9 X |
| 4,352,484 | 10/1982 | Gertz et al. | 404/6 X |
| 4,452,431 | 6/1984 | Stephens et al. | 404/6 X |
| 4,552,341 | 11/1985 | Zucker et al. | 404/6 X |

*Primary Examiner*—Ramon S. Britts
*Assistant Examiner*—N. Connolly
*Attorney, Agent, or Firm*—Shook, Hardy & Bacon

[57] ABSTRACT

An impact attenuator to absorb the impact energy of vehicle collisions. The attenuator includes a fiberglass shell which forms an interior cavity. Located within this cavity are a plurality of empty aluminum beverage cans. The cans are arranged in a three dimensional array having a number of horizontally planar rows. Each of the rows includes a plurality of columns, with each column being formed of a number of cans in end-to-end relation. The columns are aligned such that their longitudinal axes are parallel to the anticipated direction of impact, such that they will be forces to buckle under impact and thereby absorb a portion of the impact energy. The rows may each be placed in a tray-like divider having a peripheral lip to maintain the row's configuration. The entire array of cans may be surrounded by burlap to maintain the array configuration and prevent scattering of the cans after impact.

2 Claims, 2 Drawing Sheets

Fig. 1.
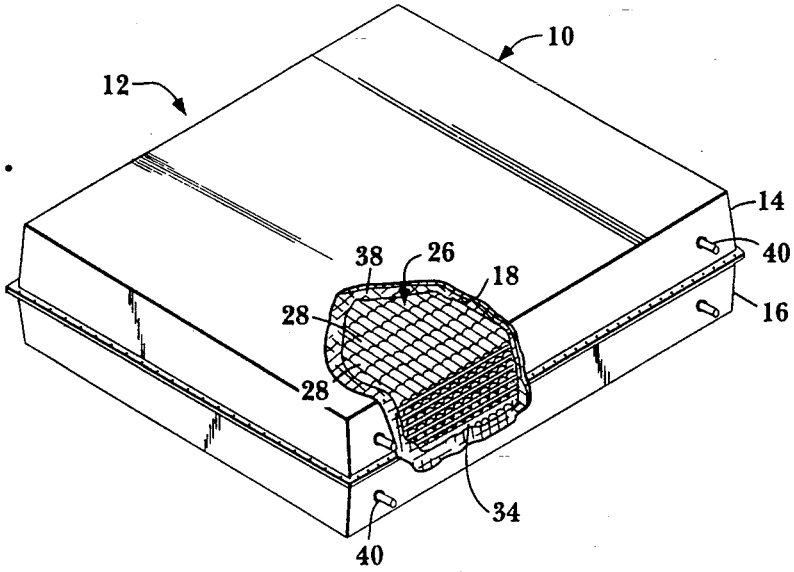
Fig. 2.
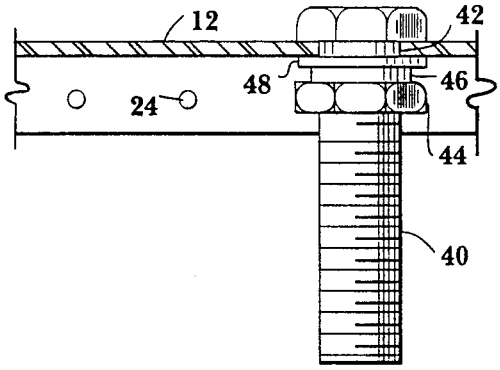
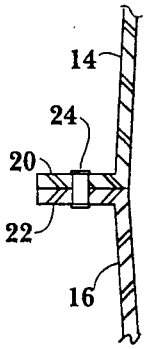
Fig. 3.
Fig. 4.
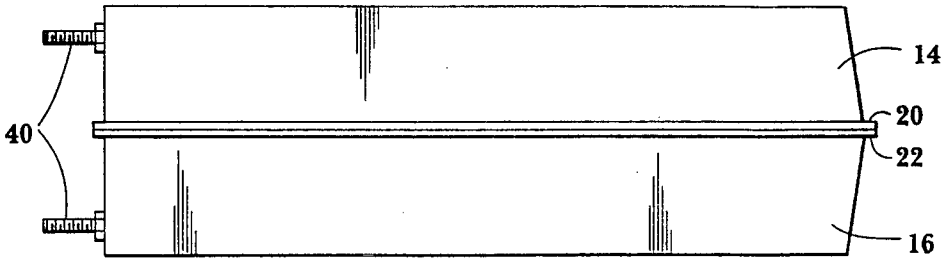

ALUMINUM CAN TRUCK-MOUNTED ATTENUATOR

BACKGROUND OF THE INVENTION

1. Field of the Invention

The present invention relates in general to motor vehicle and construction safety devices. In particular, the present invention relates to an improved impact absorption device.

2. Description of the Related Art

The use of bumpers on motor vehicles to absorb the impact of collision has been known for many years. More recently, efforts have been made to provide bumpers which attenuate the impact forces. As such, it has been known to mount the bumper to the vehicle with an impact absorbing dash pot or shock absorber arrangement. It has also been known to form the bumper with a plurality of cavities which contain water. Upon impact, these cavities break open to release the water and thus attenuate the force of the impact.

It has also been known to place impact absorption devices between the roadway and stationary objects. For example, such devices may be placed between the oncoming traffic and a pillar adjacent the roadway supporting an overpass. As with the impact attenuating bumpers, it has been known to form these devices as collapsible containers filled with water. It has also been known to fill such containers with sand.

In each of these above arrangements, the impact attenuation device has been relatively heavy, and in the case of water containing devices, difficult to maintain.

SUMMARY OF THE INVENTION

An object of the present invention is to provide an impact attenuation device which will absorb the impact forces of a motor vehicle collision.

Another object of the present invention is to provide an impact attenuation device which is lightweight.

Yet another object of the present invention is to provide an impact attenuation device which is both inexpensive to produce and to maintain.

These and other objects are achieved by an impact attenuation device comprising a fiberglass shell which defines a cavity in the interior thereof. Housed within the cavity are a plurality of layers of empty aluminum beverage cans. Each of the layers consist of a plurality of the cans stacked end to end in a column in the direction of anticipated impact. A plurality of these columns are provided for each of the layers, and the layers may be separated by a cardboard divider having an exterior lip which helps to maintain the position of the cans in each layer. A burlap shroud surrounds the assembled cans such that it is located between the cans and the fiberglass shell.

Upon impact with the present attenuator, the fiberglass shell will initially crack, allowing the forces to be transmitted to the layers of cans. Each of the stacks of cans forming the layers will be crushed at least partially during the impact, absorbing at least a portion of the impact forces. The burlap covering will prevent the crushed cans from scattering during the impact.

BRIEF DESCRIPTION OF THE DRAWINGS

The objects and features of the invention noted above are explained in more detail with reference to the drawings, in which like reference numerals denote like elements, and in which:

FIG. 1 is a perspective view with partial cutaway of the assembled attenuator according to the present invention;

FIG. 2 is a cross-sectional detail view showing the mounting studs for the present invention;

FIG. 3 is cross-sectional detail view showing the shell construction;

FIG. 4 is a side view of a first embodiment of the present invention;

DETAILED DESCRIPTION OF THE INVENTION

Figure 6:
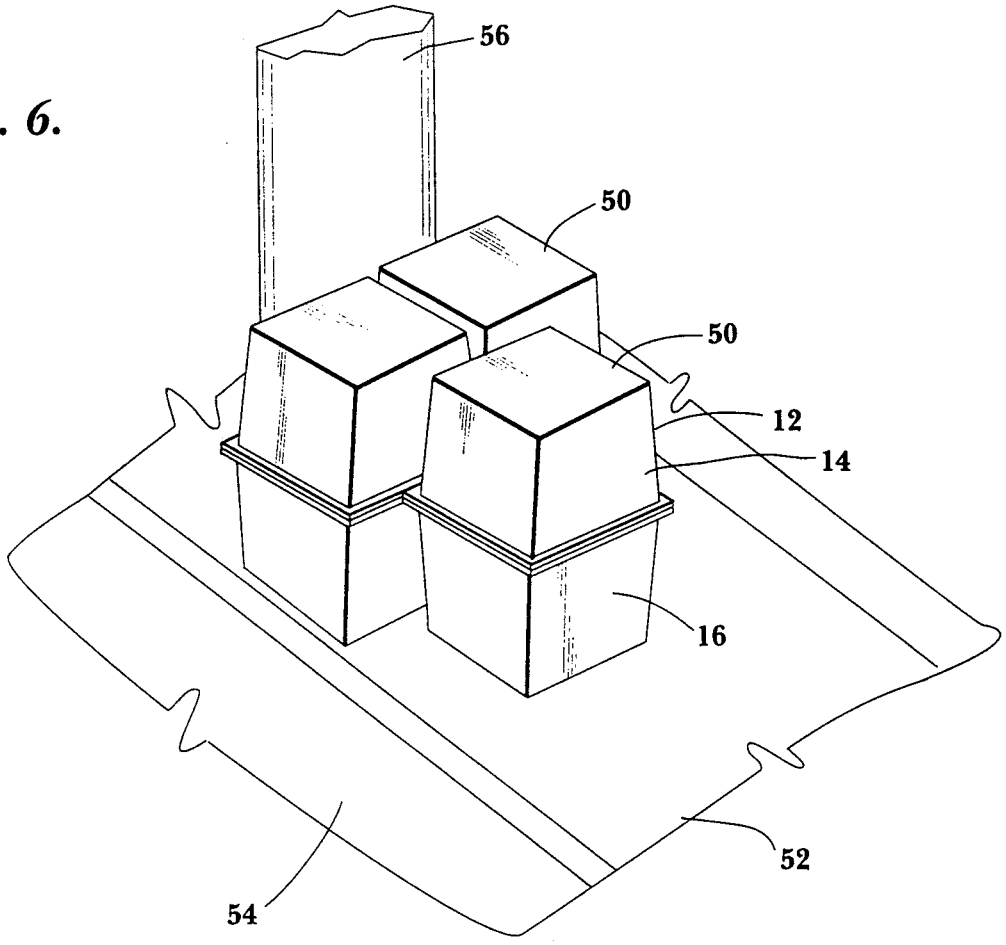
FIG. 6 is a perspective view of a second embodiment of the present invention.

With reference to FIG. 1, a first embodiment of an attenuation device according to the present invention is generally designated by reference numeral 10.

The device 10 includes an exterior shell generally designated by reference numeral 12. As shown in FIGS. 1 and 4, the exterior shell 12 comprises first and second shell portions 14 and 16, respectively. The first and second shell portions each define a concave three dimensional member such that when the shell portions are assembled, they define an interior cavity 18. For ease of assembly into this configuration, the first shell portion 14 includes a peripheral lip 20 and the second shell portion 16 includes a peripheral lip 22. When the shell portions 14 and 16 are placed in the assembled condition, the peripheral lips 20 and 22 come into abutting relationship, as is best shown in FIG. 3. A plurality of fastening means 24 connect the peripheral lips 20 and 22 about the periphery of the first and second shell portions 14 and 16. The shell may be made waterproof by providing a rubber gasket between the peripheral lips 20 and 22, by sealing the joint between the lips with silicone, or by other known means.

Since it is the function of the attenuation device 10 to absorb impact forces, it is preferred that the exterior shell 12 be formed of a material which is collapsible or breakable when subject to the forces generally encountered during a motor vehicle collision. In the present invention, it has been found particularly suitable to form the exterior shell 12 of fiberglass. This provides an exterior shell which is easily produced at low cost, yet which also provides low weight. While fiberglass is preferred, other composite materials, ceramics or even thin sheet metals may be employed for the exterior shell 12.

It should also be clear that the exterior shell 12 may be molded as a single unit, as two portions having a configuration other than that shown in the figures, or as three or more portions.

While the fastening means 24 should, of course, be of sufficient strength to maintain the shell portions in their assembled condition, it is preferred that the fastening means be of sufficient strength to maintain the shell portions at least partially assembled during collapse of the device 10 during impact, as will become apparent from the description below. For this reason, the fastening means 24 are preferably formed as pop rivets, bolts and appropriate nuts, or other equivalent fastening means.

While the structural properties of the exterior shell 12 absorb impact energy, further impact absorption is provided by a three dimensional array or honeycomb structure, generally indicated by reference numeral 26, located within the cavity 18 of the exterior shell 12.

While the array 26 may be formed of expanded metal, or appropriately formed ceramic or plastic, it is preferred that the three-dimensional array be formed of a plurality of standard metallic beverage cans 28. The cans 28 are typical aluminum cans commonly employed as soft drink containers. While this is preferred, other types of cans could be employed. It is very advantageous, however, if the cans are capable of a slight nesting to facilitate stacking the cans end to end. Such a nesting feature is present in the standard beverage can. Although not necessary, it is also preferred that the cans have been previously used for their beverage containing function. This will maximize the usefulness of the cans, and thus save natural resources. In this regard, it is noted that the cans may, of course, be recycled after their use in the device 10.

Figure 5:
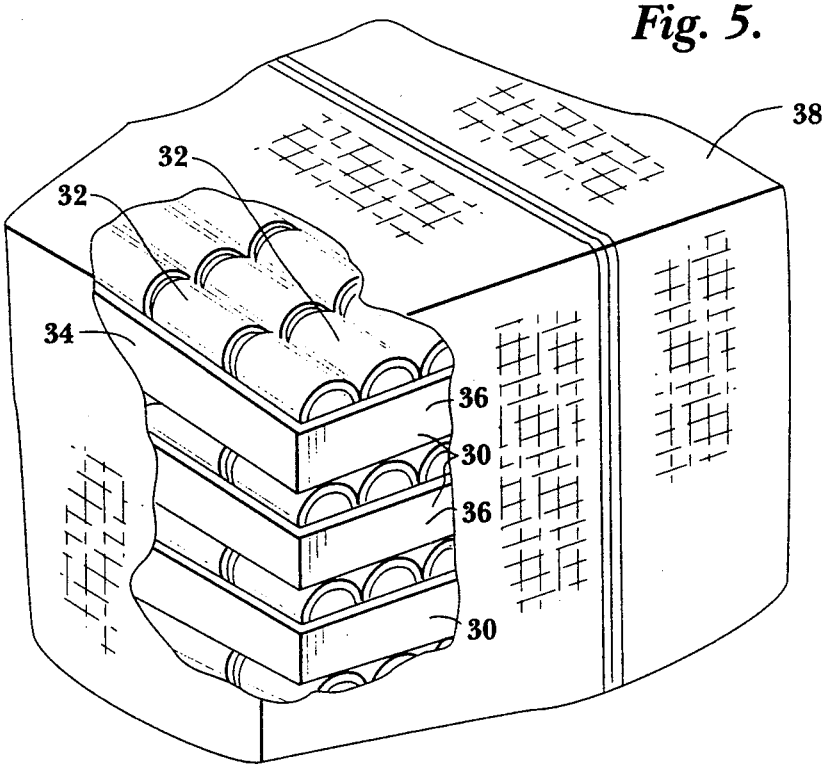
FIG. 5 is a detailed view in partial cutaway of the layers of aluminum cans.

As is best shown in FIGS. 1 and 5, the three-dimensional array of cans 28 includes a plurality of layers 30 stacked one upon the other in the vertical direction. Within each of the layers 30, the cans 28 are arranged end to end in their longitudinal direction to form a plurality of columns 32 extending in the depth direction, which is the direction of expected impact. The columns 32 are arranged side by side in rows such that each of the layers 30 includes a plurality of can columns.

The description of each of the stacks of cans as a column is believed to be particularly appropriate because each of the cans within each column, and each column, will buckle under the force of an impact directed along the longitudinal axis of the column. It is along this longitudinal axis that the greatest amount of energy absorption is believed to occur, since this is the direction which requires the greatest application of force to crush an individual can. As such, it is preferred that the columns of each of the layers 30 are aligned with the expected direction of impact. While this is preferred, it is not, of course, necessary. One or more of the layers 30, and possibly alternating layers, may have the longitudinal axis of the columns associated therewith directed substantially perpendicular, or at other angles, to the expected direction of impact.

It is preferred that each of the layers 30 be separated by a divider 34. The dividers will assist in maintaining the proper orientation and configuration of the cans 28 in each layer 30. To further assist in this, the dividers 34 may each include an upstanding peripheral lip 36. This lip 36 will maintain the cans in the proper configuration, thus assisting the assembly of the device 10. The dividers 34 may be formed of any substantially rigid material, such as plastic. It is preferred, however, that the dividers 34 be formed of cardboard sheets. The peripheral lips 36 may therefore be peripheral portions of these cardboard sheets which are folded up and affixed to each other to form the desired tray-like configuration.

While the columns 32 of cans 28 in the various layers 30 are shown in FIGS. 1 and 5 as being vertically aligned, this is not required. The columns 32 of alternating layers could, for example, be offset by a set distance, possibly one-half the diameter of a can 28. In this regard it is also noted that the dividers 34 are not essential. The layers 30 could be placed within the device 10 sequentially, with the columns of each successive layer resting on two of the columns of the immediately preceding layer. This arrangement would provide an arrangement approximating a true honeycomb structure.

Regardless of the arrangement of the cans within the device 10, it should be apparent that it is important for the cans 28 to maintain their three-dimensional and columnar arrangement to retain the maximum energy absorbing characteristics. To assist in this, the exterior shell 12 may be formed to provide a snug fit about the array of cans. Further support for the array of cans may be provided by a shroud 38 surrounding the array. Shroud 38 may be formed of a flaccid or semi-flaccid member or members which are placed about the array 26 and sealed together to form a surrounding configuration.

While paper or plastic could be employed, it is preferred that the shroud 38 be formed of burlap, which provides sufficient strength to maintain the array configuration, yet is low cost. As shown in FIG. 5, the burlap may be wrapped about the array 26 with the edges of the shroud 38 brought together and fastened to form the surrounding configuration. The edges of the shroud could be fastened by numerous means, including sewing or adhesives, although staples are preferred. In addition to assisting in maintaining the array configuration, the shroud 38 will also serve to prevent the cans 28 from scattering after impact.

To function as an impact attenuator, the device 10 must, of course, be placed at an anticipated point of impact. The embodiment shown in FIGS. 1 and 4 is particularly suited for mounting on the rear of a vehicle. To assist in this mounting a plurality of bolts 40 are provided and extend outwardly from the exterior shell 12 of the device 10. The bolts 40 may be mounted to the exterior shell by placing each bolt 40 through a through hole 42 in the shell 12. The bolt 40 may be fixed in place by a nut 44, lock washer 46 and washer 48. Appropriate reinforcement of the shell, such as a wood or metal plate, could of course be provided to ensure that the bolts do not become separated from the shell.

The outwardly extending threaded portions of the bolts 40 may then be inserted through appropriate through holes in the chassis frame, or an appropriate extension mounted to the chassis, of the vehicle and fixed thereto with appropriate nuts. In this manner, the device 10 will extend outwardly from the motor vehicle and provide impact absorption in the event of a collision.

A particularly advantageous use of the device 10 is in roadway construction and maintenance. The device 10 would be attached to the rear of a vehicle at the roadway construction site, and this vehicle would be placed between the workers and the oncoming traffic, with the device 10 facing the oncoming traffic. This would provide an additional barrier to prevent a worker from being struck by traffic.

Where the device 10 is intended to be attached to a vehicle, an advantageous size for the array 26 has been found to be nine layers 30, with each of the layers being 38 cans wide and 17 cans deep, in other words each of the columns is 17 cans long with 38 columns being provided in each of the nine layers. These dimensions are with reference to the typical aluminum beverage can which is 4¾" high and 2½" in diameter.

The impact attenuator, according to the present invention, could take other forms than that shown in the first embodiment. In particular, a second embodiment of the present invention is shown in FIG. 6. In this embodiment, the impact attenuator is formed as a free standing unit, generally designated by reference numeral 50.

The unit 50 may be formed in a manner similar to that of the first embodiment, and include an exterior shell 12 comprised of first and second shell portions 14 and 16. The unit 50 would also include a three-dimensional array of cans as in the first embodiment within the exterior shell 12. As with the first embodiment, the cans would be formed in layers and columns, and could include appropriate dividers and a shroud. The number of layers, cans per column and columns per layer would of course be modified to provide the proper exterior dimensions.

In this second embodiment, the unit 50 is free-standing and is intended to be placed between a stationary object adjacent a roadway and the oncoming traffic. For example, as shown in FIG. 6, the unit 50 may be placed upon the shoulder 52 of a roadway 54 between the oncoming traffic and a stationary object such as a pillar 56 for supporting an overpass. As shown in FIG. 6, a plurality of units 50 may be grouped together to provide further impact absorption.

As should be apparent to those skilled in the art, various other modifications could be made to the impact attenuators of the present invention to improve their safety. For example, the number of cans per column and/or columns per layer could be varied among the layers. Additionally, the exterior shells 12 could be covered with yellow and black diagonal lines or other highly visible color schemes. Reflective materials and cautionary indicia could also be placed on the exterior shells 12.

From the foregoing it will be seen that this invention is one well adapted to attain all ends and objects hereinabove set forth together with the other advantages which are obvious and which are inherent in the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matters herein set forth or shown in the accompanying drawings is to be interpreted as illustrative and not in a limiting sense.

What is claimed is:

1. An impact attenuator comprising:

an exterior shell defining an interior cavity;

a plurality of empty metallic cans housed within said cavity, said cans being arranged in a three dimensional array having a plurality of substantially parallel and planar rows, each of said rows including a plurality of columns within the plane of the row, each of said columns including a number of said cans in end-to-end relation with the longitudinal axes of said number of cans substantially aligned; and a divider disposed between each of said rows, each of said dividers including an upstanding peripheral lip surrounding said cans in the associated one of said rows.

2. An impact attenuator as in claim 1, further comprising an at least semi-flaccid shroud surrounding said plurality of cans.

* * * * *